US010236624B2

(12) United States Patent
Kwon et al.

(10) Patent No.: US 10,236,624 B2
(45) Date of Patent: Mar. 19, 2019

(54) HIGH VOLTAGE CONNECTOR FOR VEHICLE

(71) Applicants: Hyundai Motor Company, Seoul (KR); Yura Corporation Co., Ltd., Seongnam, Gyeonggi-do (KR)

(72) Inventors: Jae Min Kwon, Incheon (KR); Young Jong Lee, Seoul (KR); Moon Sik Yu, Gyeonggi-Do (KR)

(73) Assignees: Hyundai Motor Company, Seoul (KR); Yura Corporation Co., Ltd., Seongnam, Gyeonggi-do (KR)

( * ) Notice: Subject to any disclaimer, the term of this patent is extended or adjusted under 35 U.S.C. 154(b) by 274 days.

(21) Appl. No.: 15/138,605

(22) Filed: Apr. 26, 2016

(65) Prior Publication Data

US 2017/0170597 A1 Jun. 15, 2017

(30) Foreign Application Priority Data

Dec. 11, 2015 (KR) ..... 10-2015-0177340

(51) Int. Cl.
*H01R 13/53* (2006.01)
*H01R 13/703* (2006.01)
*H01R 103/00* (2006.01)

(52) U.S. Cl.
CPC ..... *H01R 13/53* (2013.01); *H01R 13/7036* (2013.01); *H01R 2103/00* (2013.01)

(58) Field of Classification Search
CPC .... H01R 2201/26; H01R 13/70; H01R 13/11; H01R 13/422
See application file for complete search history.

(56) References Cited

U.S. PATENT DOCUMENTS 4,034,172 A 7/1977 Glover et al.
7,575,476 B2 * 8/2009 Tyler ..... H01R 13/66 439/607.04
7,789,690 B1 * 9/2010 Rhein ..... H01R 13/53 439/310
7,811,115 B1 * 10/2010 Tyler ..... H01R 13/53 439/352
7,892,049 B1 * 2/2011 Andler ..... H01R 4/34 439/801
7,985,098 B2 * 7/2011 De Chazal ..... H01H 9/104 439/620.31
8,192,212 B2 * 6/2012 Casses ..... B60L 11/1818 439/181
8,328,581 B2 * 12/2012 de Chazal ..... H01R 13/684 439/620.28

(Continued)

FOREIGN PATENT DOCUMENTS

JP H10262340 A 9/1998
JP H11254966 A 9/1999

(Continued)

*Primary Examiner* — Briggitte R Hammond
(74) *Attorney, Agent, or Firm* — Mintz Levin Cohn Ferris Glovsky and Popeo, P.C.; Peter F. Corless

(57) ABSTRACT

A high-voltage connector for a vehicle is provided. The high-voltage connector includes a first connector having an open circuit terminal configured to transmit an electrical signal in one direction. Additionally, a second connector is provided and includes a plating part which is electrically in contact with the open circuit terminal of the first connector.

11 Claims, 5 Drawing Sheets

(56) References Cited

U.S. PATENT DOCUMENTS

| | | | | |
|---|---|---|---|---|
| 8,597,043 | B2 * | 12/2013 | Zhao | H01R 13/707<br>307/10.1 |
| 9,819,117 | B2 * | 11/2017 | Rollmann | H01R 13/53 |
| 2003/0176093 | A1 | 9/2003 | Ota et al. | |
| 2011/0117759 | A1 | 5/2011 | Beak et al. | |
| 2012/0208400 | A1 * | 8/2012 | De Chazal | H01R 13/506<br>439/607.58 |
| 2013/0323954 | A1 * | 12/2013 | Eckel | H01R 13/5219<br>439/271 |

FOREIGN PATENT DOCUMENTS

| | | | |
|---|---|---|---|
| JP | 2001-068223 | A | 3/2001 |
| JP | 2002-134198 | A | 5/2002 |
| JP | 2003-323929 | A | 11/2003 |
| JP | 2008-305683 | A | 12/2008 |
| KR | 10-2012-0025920 | | 3/2012 |
| KR | 10-2017-0024704 | A | 3/2017 |

* cited by examiner

HIGH VOLTAGE CONNECTOR FOR VEHICLE

CROSS-REFERENCE TO RELATED APPLICATION

This application is based on and claims the benefit of priority to Korean Patent Application No. 10-2015-0177340, filed on Dec. 11, 2015 in the Korean Intellectual Property Office, the disclosure of which is incorporated herein in its entirety by reference.

TECHNICAL FIELD

The present disclosure relates to a high voltage connector for a vehicle, and more particularly, to a high voltage connector for a vehicle that prevents an arc caused by locking and unlocking between a male terminal and a female terminal.

BACKGROUND

In general, electric apparatuses of a vehicle may be classified into electric apparatuses of an engine side and electric apparatuses of a vehicle body side. The electric apparatuses of the engine side include an ignition system including an ignition coil, a distributor high voltage cable, an ignition plug, and the like, and a charging apparatus including a generator and a regulator. The electric apparatuses of the vehicle body side include a lamp system including a lamp system for lighting, a lamp system for signs, a lamp system for signal, an instrument alarm display installed on an instrument panel, an air-conditioner, and the like, including a storage battery. Such electric apparatuses of the vehicle are connected to an electronic control unit (ECU) by a wire within a vehicle engine room. A junction block may be used as an intermediate medium connecting the wire and the ECU to each other.

The junction block is a block in which a fuse, a relay, and the like disposed in the vehicle are configured into a single assembly. Further, the junction block is a series of structures for preventing an over-current from flowing in a variety of electric apparatuses wired in the vehicle in advance. The junction block includes the fuse, a variety of terminals, the relay, and the like installed therein. In addition, a high voltage connector connected to the fuse, the variety of terminals, the relay, and the like is connected to a lower portion of the junction block.

Meanwhile, since an electric vehicle uses a high voltage, a reduction in noise has been recently researched. Further, since the electric vehicle is additionally installed with various equipments for convenience, safety devices, etc. to meet the requirements of convenience and stability of consumers, a high-capacity power source is required. Accordingly, as a power distribution system of the electric vehicle, a power system which is gradually boosted from a power system of 14V to a power system of 36V or 42V to 48V has been researched and developed.

In the electric vehicle, when current terminals connecting power supply to the respective electronic units are inserted and separated, an arc discharge occurs in the range of various voltages. The occurrence of the arc discharge may cause an adverse effect on a driver, a passenger, a mechanic, and the like. When the power system of 42V, which is the high-voltage power system, is applied, the arc discharge occurring at the terminal or the others is more than several times as compared to the power system of 14V. In other words, when the arc discharge occurs at the power system of 42V, which is the high-voltage power system, a discharge voltage thereof is about 1000V or greater. As a result, a starting-off, and the like may occur due to terminal contact defectiveness by vibration during driving on a road.

SUMMARY

The present disclosure has been made to solve the above-mentioned problems occurring in the prior art while advantages achieved by the prior art are maintained intact. An aspect of the present disclosure is to remove a separate complex structure for fixing a terminal. Further, an aspect of the present disclosure is to prevent an arc occurrence due to locking and unlocking of a high-voltage connector. However, objects of the present disclosure are not limited to the objects described above, and other objects that are not described above may be clearly understood by those skilled in the art from the following description.

According to an exemplary embodiment of the present disclosure, a high-voltage connector for a vehicle may include a first connector that includes an open circuit terminal configured to transmit an electrical signal in one direction; and a second connector that includes a holder in which a plating part which is electrically in contact with the open circuit terminal of the first connector may be formed. The first connector may include a first case forming an appearance of the connector, a first housing disposed within the first case, and a male terminal connected to a wire inserted from the exterior of the first housing, and the open circuit terminal may be formed in the first housing. The second connector may include a second case forming an appearance of the connector, and a second housing disposed within the second case, and the holder may be disposed within the second housing, and may be in contact with the open circuit terminal to form a closed loop between the first connector and the second connector.

Further, a plurality of open circuit terminals may be disposed to be in contact with the plating part (e.g., abutting the plating part). The second connector may include an elastic member configured to support the first connector. The second connector may further include a second case forming an appearance of the connector, and a second housing disposed within the second case, and the elastic member configured to elastically support the second housing may be disposed on the holder to provide an abutting connection between the plating part and the open circuit terminal. The second housing may include a female terminal into which the male terminal may be inserted, a terminal connecting part connected to the male terminal may be disposed in the female terminal.

The second connector may include an elastic member that provides the abutting connection between the plating part and the open circuit terminal, the male terminal may be inserted into the front of the terminal connecting part, and the elastic member may be disposed at the rear of the terminal connecting part. The second housing may include a holder seating part on which the elastic member is disposed at an insertion side inserted into the second case. The front of the open circuit terminal may protrude toward a direction in which the open circuit terminal is inserted into the second connector, and may be in contact with the plating part. The open circuit terminal may be disposed to be to be parallel to the male terminal.

Specific matters of other exemplary embodiments will be included in a detailed description and the accompanying drawings.

BRIEF DESCRIPTION OF THE DRAWINGS

The above and other objects, features and advantages of the present disclosure will be more apparent from the following detailed description taken in conjunction with the accompanying drawings.

DETAILED DESCRIPTION

Figure 1:
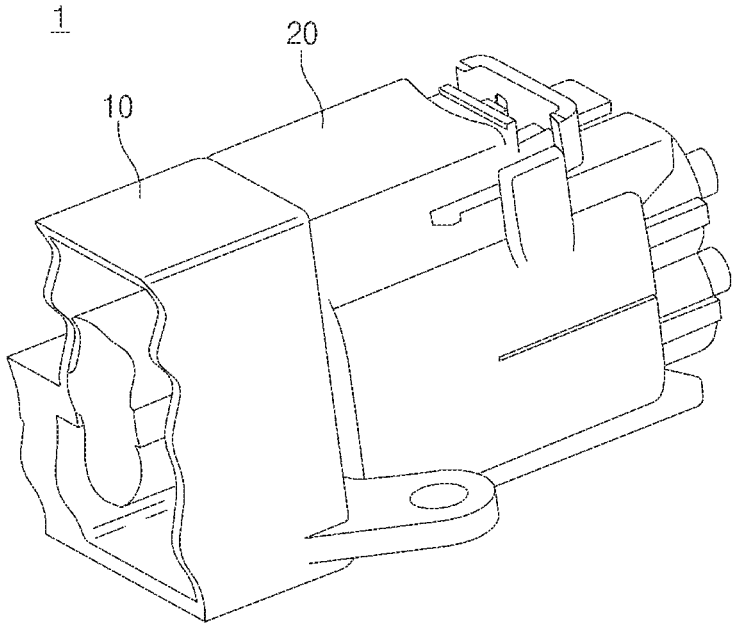
FIG. 1 is a view illustrating a high-voltage connector for a vehicle according to an exemplary embodiment of the present disclosure.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum). As referred to herein, a hybrid vehicle is a vehicle that has two or more sources of power, for example both gasoline-powered and electric-powered vehicles.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

Advantages and features of the present disclosure and methods to achieve them will be elucidated from exemplary embodiments described below in detail with reference to the accompanying drawings. However, the present disclosure is not limited to exemplary embodiments disclosed below, but will be implemented in various forms. The exemplary embodiments of the present disclosure make disclosure of the present disclosure thorough and are provided so that those skilled in the art can easily understand the scope of the present disclosure. Therefore, the present disclosure will be defined by the scope of the appended claims. Like reference numerals throughout the specification denote like elements.

Hereinafter, the present disclosure will be described with reference to the accompanying drawings for describing a high-voltage connector for a vehicle according to exemplary embodiments of the present disclosure.

Figure 2:
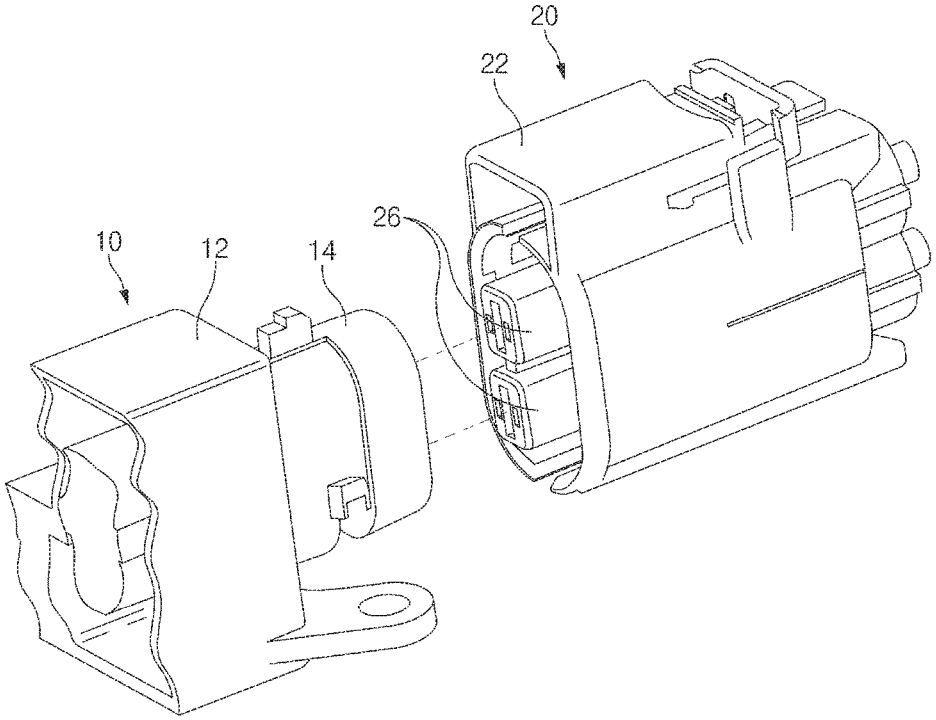
FIG. 2 is a detailed view illustrating the high-voltage connector for a vehicle.
Figure 3A:
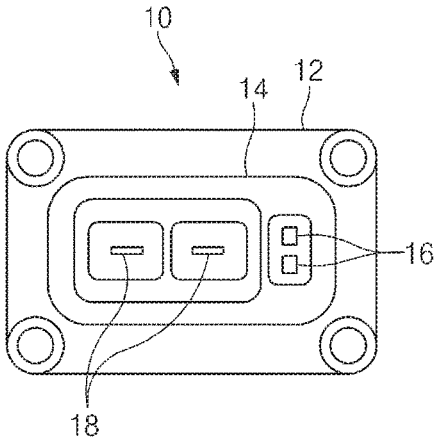
FIGS. 3A and 3B is a front view illustrating a first connector and a second connector according to an exemplary embodiment of the present disclosure.
Figure 3B:
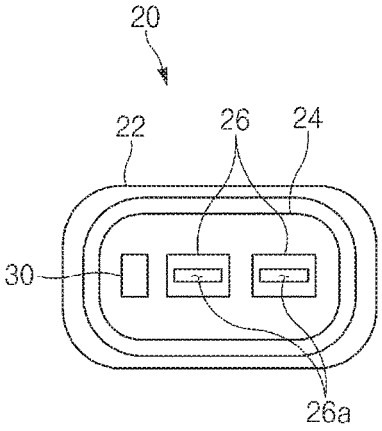
Figure 4:
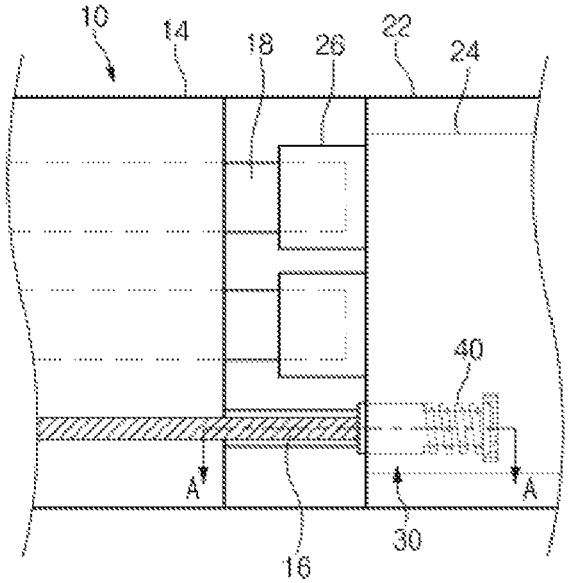
FIG. 4 is a projection plan view of FIG. 1 according to an exemplary embodiment of the present disclosure.
Figure 5:
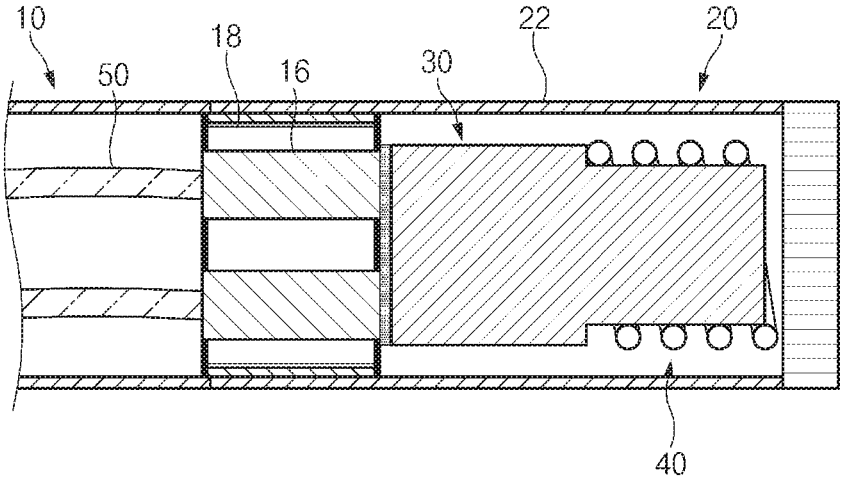
FIG. 5 is a cross-sectional view taken along the line A-A of FIG. 4 according to an exemplary embodiment of the present disclosure.

FIG. 1 is a view illustrating a high-voltage connector for a vehicle according to an exemplary embodiment of the present disclosure, FIG. 2 is a detailed view illustrating the high-voltage connector for a vehicle, FIGS. 3A and 3B is a front view illustrating a first connector and a second connector, FIG. 4 is a projection plan view of FIG. 1, and FIG. 5 is a cross-sectional view taken along the line A-A of FIG. 4.

A high-voltage connector for a vehicle may be modified by those skilled in the art, and the present exemplary embodiment corresponds to a case of a high-voltage connector for a vehicle. FIG. 1 is a view illustrating a high-voltage connector for a vehicle according to an exemplary embodiment of the present disclosure, FIG. 2 is a detailed view illustrating the high-voltage connector for a vehicle, and FIGS. 3A and 3B is a front view illustrating a first connector and a second connector.

In describing a high-voltage connector 1 for a vehicle according to the present disclosure with reference to FIGS. 1 and 3, the high-voltage connector 1 for a vehicle may include a first connector 10 that has an open circuit terminal 16 configured to transmit an electrical signal in one direction, and a second connector 20 that has a holder 30 in which a plating part which is electrically in contact with the open circuit terminal 16 of the first connector 10 may be formed. The first connector 10 may include a first case 12 forming an appearance of the connector (e.g., is the outer body of the connector), and a first housing 14 which may be mounted within the first case 12. The first connector 10 may further include a male terminal 18 electrically connected from the exterior of the first connector 10.

Furthermore, the first case 12 may include an accommodating space formed therein, and the first housing 14 may be inserted into the accommodating space. The first housing 14 may include the open circuit terminal 16 and the male terminal 18 and the first housing 14 may be inserted into the accommodating space of the first case 12 to be fixed by a general coupling method such as a hook locking, or the like. Additionally, the first housing 14 may include a male terminal 18 electrically connected to the exterior of the first housing 14. The first housing 14 may further include the open circuit terminal 16 configured to transmit the electrical signal in one direction. The open circuit terminal 16 may be configured to transmit the electrical signal to the first connector 10 in one direction. A plurality of open circuit terminals 16 may be provided.

According to an exemplary embodiment, the open circuit terminal 16 may be disposed to be parallel to the male terminal 18. The front of the open circuit terminal 16 may protrude toward a direction in which the open circuit terminal 16 is inserted into the second connector 20. The rear of the open circuit terminal 16 may be electrically connected to a wire 50. The second connector 20 may include the holder 30 in which the plating part which is electrically in contact with the open circuit terminal 16 of the first connector 10 may be formed. Additionally, the second connector 20 may include a second case 22 forming an appearance of the connector (e.g., is the outer body of the connector), and a second housing 24 which may be mounted within the second case 22.

The second case 22 may include an accommodating space formed therein, and the second housing 24 may be inserted into the accommodating space. The second housing 24 may be fixed to the second case 22 by a general coupling method such as a hook locking, or the like. The second housing 24 may further include a female terminal 26 into which the male terminal 18 may be inserted, and the holder 30 in which the plating part which is in contact with the open circuit terminal 16 may be formed.

FIG. 4 is a projection plan view of FIG. 1 and FIG. 5 is a cross-sectional view taken along the line A-A of FIG. 4. In describing the high-voltage connector 1 for a vehicle according to the present disclosure with reference to FIGS. 4 and 5, the second housing 24 may include a holder seating part on which the holder 30 is disposed. The holder 30 to which an elastic member 40 is coupled to support the holder 30 may be disposed on the holder seating part.

Moreover, the female terminal 26 may include a terminal connecting part 26*a* connected to the male terminal 18. The female terminal 26 may be formed to be horizontal with a ground may include an insertion space into which the male terminal 18 is inserted. The female terminal 26 may also include the terminal connecting part 26*a* electrically connected to the male terminal 18. The holder 30 may be disposed in the second housing 24 to be in contact with the open circuit terminal 16. When the first connector 10 is inserted into the second connector 20, the holder 30 may be provided with the plating part which is in contact with the open circuit terminal 16. The holder 30 may be disposed to be parallel to the female terminal 26 and may include the plating part formed at the front which is in contact with the open circuit terminal 16, and an elastic member 40 may be disposed at the rear of the plating part.

When the plating part of the holder 30 and the open circuit terminal 16 are in contact with each other, a closed loop between the first connector 10 and the second connector 20 may be formed. As a result, a current may flow between the male terminal 18 and the female terminal 26, to thus prevent an arc occurrence. Meanwhile, the plating part of the holder may be is supported by the elastic member 40 to be in contact with the male terminal 18. The elastic member 40 may be configured to support the holder 30 along an insertion direction of the first connector 10. The elastic member 40 may be elastically supported by the second housing 24 to provide an abutting connection (e.g., a sealed connection, a tight connection, etc.) between the plating part of the holder 30 and the open circuit terminal 16. Accordingly, an operation of the high-voltage connector for a vehicle according to an exemplary embodiment of the present disclosure having the configuration as described above will be described.

FIG. 4 is a projection plan view of FIG. 1 and FIG. 5 is a cross-sectional view taken along the line A-A of FIG. 4. Referring to FIGS. 4 and 5, in the high-voltage connector 1, when inserting the first connector 10 into the second connector 20 to be coupled to each other, the male terminal 18 may be inserted into the female terminal 26 to be matched to (e.g., to correspond to) the female terminal 26. The male terminal 18 and the terminal connecting part 26*a* may be electrically connected to each other by the insertion of the male terminal 18. Meanwhile, the open circuit terminal 16 may be in contact with the plating part. However, the second housing 24 may be pushed in an insertion direction of the first connector 10 by pressurization that occurs during an insertion process of the first connector 10. Accordingly, an arc may occur between the first connector 10 and the second connector 20.

In particular, the second housing 24 may be supported by the elastic member 40 in an insertion opposite direction of the first connector 10. The second housing 24 may be supported by the elastic member 40 disposed between the second case 22 and the second housing 24. The elastic member 40 is configured to provide an abutting connection between the open circuit terminal 16 and the plating part of the holder 30, thus causing the open circuit terminal 16 and the plating part of the holder 30 to be in an abutting connection as well and allowing a current of high voltage to flow between the male terminal 18 and the female terminal 26.

When a state is changed from a state in which the open circuit terminal 16 and the plating part of the holder 30 are in contact with each other to a state in which they are separated (e.g., no longer abut each other), the current is prevented from flowing and the arc between the terminals does not occur. Further, the male terminal 18 may be configured to prevent the separation from the female terminal 26, and the plating part of the holder 30 may abut the open circuit terminal 16, to thus prevent the arc occurrence.

In the high-voltage connector for a vehicle according to an exemplary embodiment of the present disclosure as describe above, the plating made of by a conductive material may be formed integrally with the female terminal, to thus reduce cost. Additionally, when the open circuit terminal and the plating part are separated from each other, the flow of current between the male terminal and the female terminal is blocked, thereby making it possible to prevent the arc. In the high-voltage connector for a vehicle according to an exemplary embodiment, the configuration and the method of the above-mentioned exemplary embodiments are not restrictively applied. In other words, all or some of the respective exemplary embodiments may be selectively combined with each other so that they may be variously modified.

According to the present disclosure, the high-voltage connector for a vehicle has the following effects.

First, in the high-voltage connector for a vehicle according to the present disclosure, the plating may be formed integrally with the female terminal by the conductive material, to thus reduce the cost.

Second, in the high-voltage connector for a vehicle according to the present disclosure, since the plating is not limited to the position of the connector, there is an advantage in the design freedom of the connector.

Third, in the high-voltage connector for a vehicle according to the present disclosure, when the open circuit terminal and the plating part are separated from each other, the flow of current between the male terminal and the female terminal is blocked, thereby making it possible to prevent the arc.

Fourth, in the high-voltage connector for a vehicle according to the present disclosure, the separate complex structure for fixing the terminal may be omitted, thereby making it possible to reduce the cost.

However, effects of the present disclosure are not limited to the effects described above, and other effects that are not described above may be clearly understood by those skilled in the art from the claims.

Hereinabove, although the present disclosure has been described with reference to exemplary embodiments and the accompanying drawings, the present disclosure is not limited thereto, but may be variously modified and altered by those skilled in the art to which the present disclosure pertains without departing from the spirit and scope of the present disclosure claimed in the following claims.

What is claimed is:

1. A high-voltage connector for a vehicle, comprising:

a first connector that includes an open circuit terminal configured to transmit an electrical signal in one direction; and a second connector that includes a holder having a plating part which is electrically in contact with the open circuit terminal of the first connector, wherein the holder includes an elastic member configured to provide an abutting connection between the plating part and the open circuit terminal, and wherein the first connector includes:

a first case forming an appearance of the connector;

a first housing mounted within the first case; and a male terminal connected to a wire inserted from the exterior of the first housing, wherein the open circuit terminal is formed in the first housing.

2. The high-voltage connector according to claim 1, wherein the second connector includes:

a second case forming an appearance of the connector; and a second housing mounted within the second case, wherein the holder is disposed in the second housing, and is in contact with the open circuit terminal to form a closed loop between the first connector and the second connector.

3. The high-voltage connector according to claim 1, wherein a plurality of open circuit terminals are provided to be in contact with the plating part.

4. The high-voltage connector according to claim 1, wherein the elastic member is configured to support the first connector.

5. The high-voltage connector according to claim 4, wherein the second connector includes:

a second case forming an appearance of the connector; and a second housing mounted within the second case, wherein the elastic member elastically supporting the second housing is disposed on the holder to provide an abutting connection between the plating part and the open circuit terminal.

6. The high-voltage connector according to claim 2, wherein the second housing includes a female terminal into which the male terminal is inserted, a terminal connecting part connected to the male terminal is disposed in the female terminal.

7. The high-voltage connector according to claim 6, wherein the second connector includes an elastic member configured to provide an abutting connection between the plating part and the open circuit terminal, the male terminal is inserted into the front of the female terminal, and the elastic member is disposed at the rear of the female terminal.

8. The high-voltage connector according to claim 7, wherein the second housing includes a holder seating part on which the elastic member is disposed at an insertion side inserted into the second case.

9. The high-voltage connector according to claim 1, wherein a front of the open circuit terminal protrudes toward a direction in which the open circuit terminal is inserted into the second connector, and is in contact with the plating part.

10. The high-voltage connector according to claim 1, wherein the open circuit terminal is disposed to be parallel to the male terminal.

11. A high-voltage connector for a vehicle, comprising:

a first connector that includes a first housing mounted within a first case forming an appearance of the connector, a male terminal connected to a wire externally inserted into the first housing, and an open circuit terminal arranged together with the male terminal; and a second connector that includes a second housing mounted within a second case forming an appearance of the connector and a holder having a plating part, wherein the first connector is inserted into the second connector, to provide an abutting connection between the open circuit terminal and the plating part, and wherein the holder includes an elastic member configured to provide the abutting connection between the plating part and the open circuit terminal.

* * * * *